US010376119B2

(12) United States Patent
Ming et al.

(10) Patent No.: US 10,376,119 B2
(45) Date of Patent: Aug. 13, 2019

(54) STEAM CLEANER

(71) Applicant: Midea Group Co., Ltd., Foshan (CN)

(72) Inventors: Lele Ming, Foshan (CN); Hui Zhang, Foshan (CN); Jizhe Zhang, Foshan (CN); Qian Xu, Foshan (CN); Yanqing Deng, Foshan (CN)

(73) Assignee: MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 15/307,981

(22) PCT Filed: May 31, 2016

(86) PCT No.: PCT/CN2016/084169
§ 371 (c)(1),
(2) Date: Oct. 31, 2016

(87) PCT Pub. No.: WO2017/101257
PCT Pub. Date: Jun. 22, 2017

(65) Prior Publication Data

US 2018/0271345 A1 Sep. 27, 2018

(30) Foreign Application Priority Data

Dec. 16, 2015 (CN) ..... 2015 1 0947181
Dec. 16, 2015 (CN) ..... 2015 2 1064411 U

(51) Int. Cl.
*A47L 9/28* (2006.01)
*A47L 9/00* (2006.01)
(Continued)

(52) U.S. Cl.
CPC ..... *A47L 9/2889* (2013.01); *A47L 9/00* (2013.01); *A47L 11/34* (2013.01); *A47L 11/4086* (2013.01); *A47L 25/00* (2013.01)

(58) Field of Classification Search
CPC ..... A47L 9/00; A47L 9/2889
(Continued)

(56) References Cited

U.S. PATENT DOCUMENTS 8,549,697 B1 * 10/2013 Moyher, Jr. ..... A47L 11/34 15/319
2010/0180573 A1 7/2010 Ruston
(Continued)

FOREIGN PATENT DOCUMENTS

CN 2271874 Y 1/1998
CN 1330523 A 1/2002
(Continued)

OTHER PUBLICATIONS

PCT/CN2016/084169 International Search Report & Written Opinion dated Sep. 14, 2016 with brief English translation, 2 pages.
(Continued)

*Primary Examiner* — Michael E Barr
*Assistant Examiner* — Tinsae B Ayalew
(74) *Attorney, Agent, or Firm* — Kilpatrick Townsend & Stockton, LLP

(57) ABSTRACT

A steam cleaner is provided, including: a base (2) provided with an air inlet (4); a casing (1) disposed on the base (2) and having an air outlet (11) in a side wall thereof, in which a vortex air duct is defined between a bottom wall (16) of the casing and the base (2), and the air inlet (4) is in fluid communication with the vortex air duct; a fan (7) disposed within the casing (1), and including an electric motor (71) and a heat dissipation fan wheel (72) connected to a lower end of an electric motor shaft of the electric motor, in which the vortex air duct is configured to guide air entering from the air inlet (4) to the heat dissipation fan wheel so as to dissipate heat of the electric motor.

10 Claims, 4 Drawing Sheets

(51) Int. Cl.
*A47L 11/34* (2006.01)
*A47L 11/40* (2006.01)
*A47L 25/00* (2006.01)

(58) Field of Classification Search
USPC ..... 134/105
See application file for complete search history.

(56) References Cited

U.S. PATENT DOCUMENTS

| | | | | |
|---|---|---|---|---|
| 2013/0091815 | A1* | 4/2013 | Smith | A47L 9/102 55/346 |
| 2013/0219758 | A1* | 8/2013 | Jiang | D06F 73/00 38/144 |

FOREIGN PATENT DOCUMENTS

| | | | |
|---|---|---|---|
| CN | 1426757 | A | 7/2003 |
| CN | 1500434 | A | 6/2004 |
| CN | 1600225 | A | 3/2005 |
| CN | 201316176 | Y | 9/2009 |
| CN | 201320131 | Y | 10/2009 |
| CN | 103027638 | A | 4/2013 |
| CN | 202908619 | U | 5/2013 |
| CN | 103868306 | A | 6/2014 |
| CN | 203978881 | U | 12/2014 |
| CN | 105708388 | A | 6/2016 |
| CN | 205359358 | U | 7/2016 |
| JP | 63-297952 | A | 12/1988 |

OTHER PUBLICATIONS

Chinese Patent Application No. 201510947181.3 First Office Action dated Oct. 17, 2016, with English translation, 9 pages.
Chinese Patent Application No. 201510947181.3 Second Office Action dated Mar. 30, 2017, with English translation, 9 pages.

* cited by examiner

STEAM CLEANER

RELATED APPLICATIONS

This U.S. application is a U.S. National Phase application of the International Patent Application No. PCT/CN2016/084169, filed May 31, 2016, which claims the benefit of prior Chinese Applications No. 201521064411.3, filed Dec. 16, 2015 and No. 201510947181.3, filed Dec. 16, 2015. The entire contents of the before-mentioned patent applications are incorporated by reference as part of the disclosure of this U.S. application.

FIELD

The present disclosure relates to a field of cleaner technology, and especially, to a steam cleaner.

BACKGROUND

For a steam cleaner in the related art, a high-speed centrifugal fan provides power to suck garbage into a filtering device of the steam cleaner, and the garbage is left in the filtering device and clean air is exhausted out of a machine body through a separating function of an air-garbage separating device downstream. A safe operation and a service life of the steam cleaner are influenced by a heat dissipation of the fan, and an air duct arrangement in the related art has a poor air flow performance, thus resulting in a bad heat dissipation of an electric motor and influencing a safety performance of the steam cleaner.

SUMMARY

The present disclosure aims to solve at least one of the technical problems in the related art. Thus, the present disclosure provides a steam cleaner. A fan of the steam cleaner has a good heat dissipation effect, air for heat dissipation has a good flow performance, and the steam cleaner has a high safety performance.

The steam cleaner according to embodiment of the present disclosure includes: a base provided with an air inlet; a casing disposed on the base and having an air outlet in a side wall thereof, in which a vortex air duct is defined between a bottom wall of the casing and the base, and the air inlet is in fluid communication with the vortex air duct; a fan disposed within the casing, and including an electric motor and a heat dissipation fan wheel connected to a lower end of an electric motor shaft of the electric motor, in which the vortex air duct is configured to guide air entering from the air inlet to the heat dissipation fan wheel so as to dissipate heat of the electric motor.

With the steam cleaner according to embodiments of the present disclosure, the vortex air duct is defined between the casing and the base, the vortex air duct has functions of gathering air flows and providing a velocity circulation before the air flows to the fan, and thus the air may present a convergent flow in the vortex air duct, such that it is convenient for the air to enter the heat dissipation fan wheel, and the air for heat dissipation conforms to a flow rule well, thereby promoting the flow of the air.

According to an example of the present disclosure, a partition plate assembly extends downwards from the bottom wall of the casing, the partition plate assembly is configured to have a volute shape, and the vortex air duct is defined by the partition plate assembly, the bottom wall of the casing and the base together.

According to an example of the present disclosure, the partition plate assembly includes: a first partition plate defining a first ring cavity and a flat-straight cavity communicated with the first ring cavity, in which the flat-straight cavity is communicated with the air inlet; a second partition plate defining a second ring cavity and disposed inside the first ring cavity, in which a first flow channel having a gradually decreasing width is defined between the second partition plate and the first partition plate, the second ring cavity is provided with an opening thereinside, the opening is communicated with an air intake end of the heat dissipation fan wheel, and the first flow channel is communicated with the opening via a second flow channel located in the second ring cavity.

According to an example of the present disclosure, the second partition plate is configured to be a ring plate and the ring plate has at least one first notch.

According to an example of the present disclosure, the at least one first notch is formed in a position along the ring plate away from the flat-straight cavity.

According to an example of the present disclosure, two to five first notches are provided and spaced apart from one another.

According to an example of the present disclosure, the steam cleaner further includes: a third partition plate disposed around the opening and having at least one second notch, in which the first notch is communicated with the second notch via the second flow channel.

According to an example of the present disclosure, the second notch is arranged away from the first notch in a circumferential direction of the opening.

According to an example of the present disclosure, the third partition plate is concentric with the second partition plate.

According to an example of the present disclosure, a hollow cavity is further defined between the bottom wall of the casing and the base, the air inlet is corresponding to the hollow cavity in terms of positions thereof, and the vortex air duct is communicated with the hollow cavity.

According to an example of the present disclosure, a control mainboard of the steam cleaner is disposed within the hollow cavity, so that the air entering from the air inlet passes through the control mainboard firstly.

According to an example of the present disclosure, at least one of a length, a width and a depth of the hollow cavity is larger than a corresponding dimension of the control mainboard.

Additional aspects and advantages of the present disclosure will be given in part in the following descriptions, become apparent in part from the following descriptions, or be learned from the practice of the of the present disclosure.

BRIEF DESCRIPTION OF THE DRAWINGS

These and other aspects and advantages of embodiments of the present disclosure will become apparent and more readily appreciated from the following descriptions made with reference to the drawings, in which.

REFERENCE NUMERALS

Figure 1:
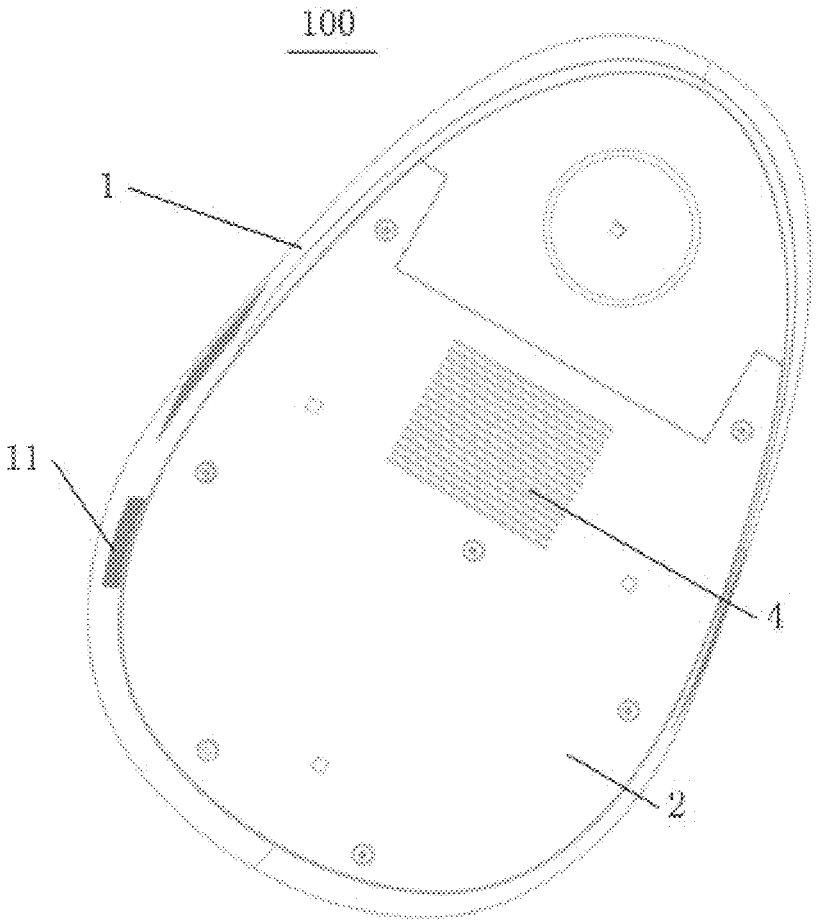
FIG. 1 is a schematic view of a steam cleaner according to embodiments of the present disclosure.

100: steam cleaner;

1: casing, 11: air outlet, 12: baffle, 13: accommodating portion of fan, 14: air vent, 15: opening, 16: bottom wall of casing;

2: base;

3: control mainboard;

4: air inlet;

5: hollow cavity;

6: partition plate assembly, 61: first partition plate, 611: flat-straight cavity, 612: first flow channel, 62: second partition plate, 621: first notch, 63: third partition plate, 622: second flow channel, 631: second notch;

7: fan, 71: electric motor, 72: heat dissipation fan wheel.

DETAILED DESCRIPTION

Embodiments of the present disclosure will be described in detail in the following. Examples of the embodiments are shown in the drawings. The same or similar elements and the elements having same or similar functions are denoted by like reference numerals throughout the descriptions. The embodiments described herein with reference to drawings are explanatory, and used to generally understand the present disclosure, and shall not be construed to limit the present disclosure.

In the specification, it is to be understood that terms such as "central", "longitudinal", "lateral", "length", "width", "thickness", "upper", "lower", "front", "rear", "left", "right", "vertical", "horizontal", "top", "bottom", "inner", "outer", "clockwise", "counterclockwise", "axial direction", "radium direction" and "circumferential direction" should be construed to refer to the orientation as then described or as shown in the drawings under discussion. These relative terms are for convenience of description and do not indicate or imply that the device or element be constructed or operated in a particular orientation, thus cannot be construed to limit the present disclosure. In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted", "connected", "communicated" are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

A steam cleaner 100 according to embodiments of the present disclosure will be described with reference to FIG. 1 to FIG. 6.

As shown in FIG. 1 to FIG. 6, the steam cleaner 100 according to embodiments of the present disclosure includes a base 2, a casing 1 and a fan 7.

Figure 2:
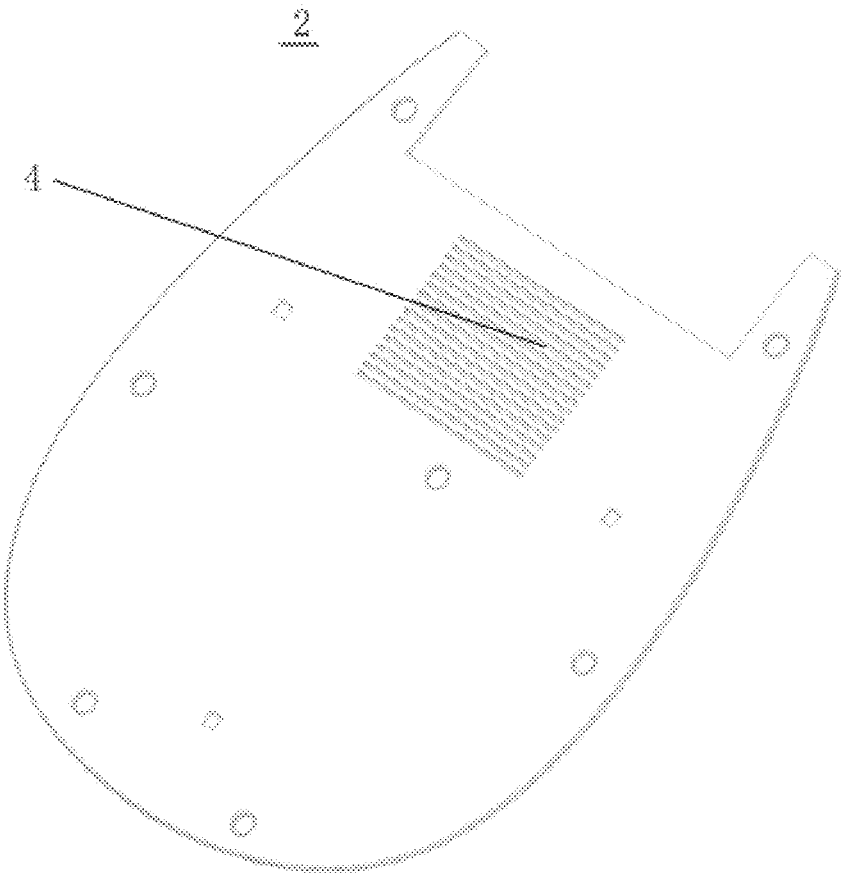
FIG. 2 is a schematic view of a base of a steam cleaner according to embodiments of the present disclosure.

As shown in FIG. 1 and FIG. 2, the base 2 is provided with an air inlet 4. In an example shown in FIG. 2, the base 2 may be configured to be a plate-shaped structure, and the air inlet 4 is formed in the base 2 and passes through the base 2. When the steam cleaner 100 is located on the ground, the air inlet 4 is arranged to face the ground, and such arrangement can reduce a noise to some extent. Optionally, the air inlet 4 may be configured to be an air inlet grille including a plurality of grille bars, and the plurality of grille bars may be disposed in a parallel or cross manner, thus facilitating filtering the air entering from the air inlet 4 and preventing dirt in the air from entering the steam cleaner 100 along with the air.

Figure 4:
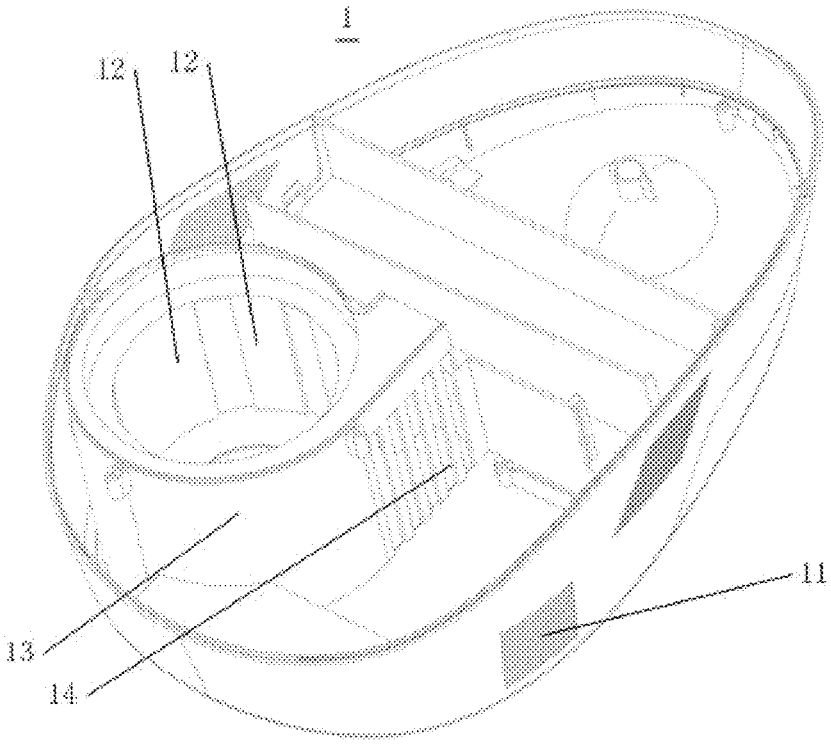
FIG. 4 is a schematic view of a casing of a steam cleaner according to embodiments of the present disclosure.
Figure 5:
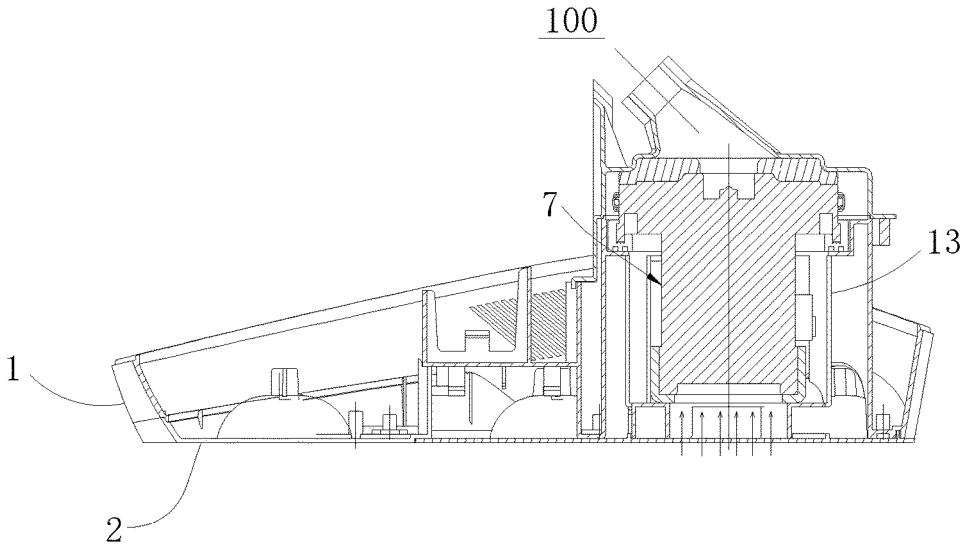
FIG. 5 is a sectional view of a steam cleaner according to embodiments of the present disclosure.
Figure 6:
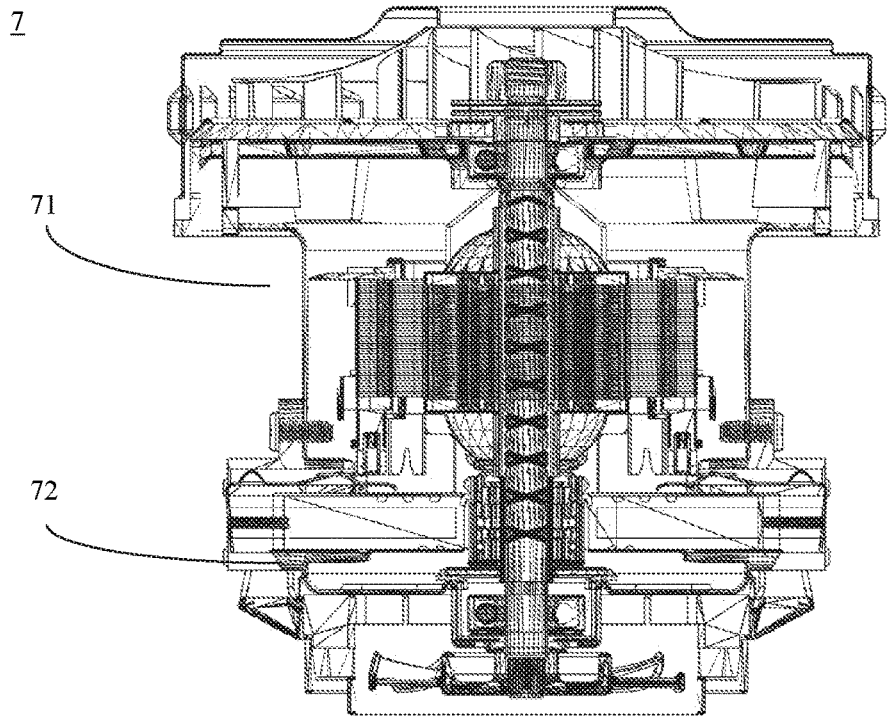
FIG. 6 is a sectional view of a fan of a steam cleaner according to embodiments of the present disclosure.

As shown in FIG. 1 and FIG. 2, the casing 1 is disposed on the base 2 and has an air outlet 11 in a side wall thereof, a vortex air duct is defined between a bottom wall 16 of the casing and the base 2, and the air inlet 4 is in fluid communication with the vortex air duct. As shown in FIGS. 4-6, the fan 7 is disposed within the casing 1, and includes an electric motor 71 and a heat dissipation fan wheel 72 connected to a lower end of an electric motor shaft of the electric motor 71, in which the vortex air duct is configured to guide air entering from the air inlet 4 to the heat dissipation fan wheel 72 so as to dissipate heat of the electric motor 71.

Figure 3:
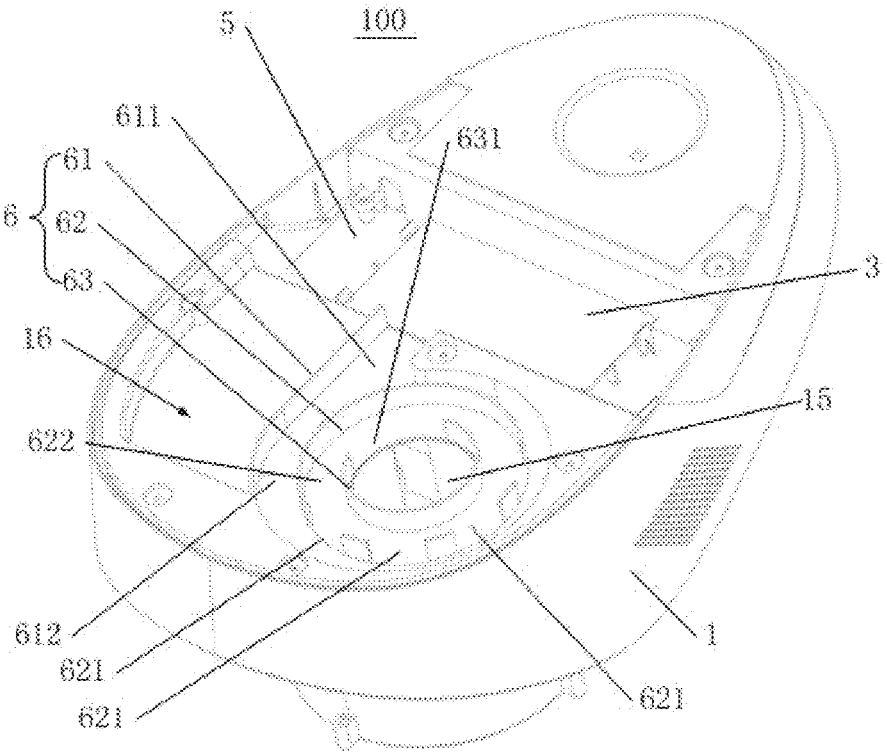
FIG. 3 is a schematic view of a bottom portion of a casing of a steam cleaner according to embodiments of the present disclosure.

Specifically, as shown in FIG. 3, the vortex air duct is formed upstream of the heat dissipation fan wheel 72, the air inlet 4 is communicated with an inlet end of the vortex air duct, and the air flows into the vortex air duct from the air inlet 4. The vortex air duct has functions of gathering air flows and providing a velocity circulation before the air flows to the fan 7, and the air presents a convergent flow in the vortex air duct, such that it is convenient for the air to enter the heat dissipation fan wheel 72, and the air for heat dissipation conforms to a flow rule well, thus promoting the air to flow. Optionally, a logarithmic spiral shape may be adopted for the vortex air duct. Meanwhile, a noise produced by the heat dissipation fan wheel 72 can be blocked effectively via the vortex air duct.

The fan 7 includes the electric motor 71 and the heat dissipation fan wheel 72, and the heat dissipation fan wheel 72 is disposed to the lower end of the electric motor shaft. The electric motor shaft can drive a rotation of the heat dissipation fan wheel 72, and the air flows to the heat dissipation fan wheel 72 along the vortex air duct. Further, the fan 7 may further include an electric motor housing, the heat dissipation fan wheel 72 and the electric motor 71 are disposed within the electric motor housing, and a heat dissipation air duct may be formed in the electric motor housing. An air vent of the electric motor housing may be formed in a portion, outside of the electric motor 71, of the electric motor housing, and specifically in an upper part of the portion of the electric motor housing. The air enters the heat dissipation air duct from the heat dissipation fan wheel 72 at a bottom portion of the electric motor 71, and flows in the heat dissipation air duct along an axial direction of the electric motor 71 to take away heat of the electric motor 71. Then, the hot air after heat exchange is exhausted from the air vent of the electric motor housing, and further exhausted out of the casing 1 from the air outlet 11 in the side wall of the casing 1.

With the steam cleaner 100 according to embodiments of the present disclosure, the vortex air duct is defined between the casing 1 and the base 2, and has functions of gathering air flows and providing the velocity circulation before the air flows to the fan 7, so that the air presents the convergent flow in the vortex air duct. Thus, it is convenient for the air to enter the heat dissipation fan wheel 72, and the air for heat dissipation conforms to the flow rule well, thereby promoting the air to flow.

In some embodiments of the present disclosure, as shown in FIG. 4, a plurality of baffles 12 is formed at an outer side of the fan 7, and the plurality of baffles 12 extends along an axial direction of the fan 7 and is spaced apart from one another along a circumferential direction of the fan 7.

The air after heat exchange flows out of the fan 7 and further flows between the plurality of baffles 12 and the fan 7 along the circumferential direction of the fan 7. Then, the air flows out between adjacent baffles 12, thereby reducing a flowing speed of the air and also facilitating blocking the noise. Further, the steam cleaner 100 also includes a steam generator, and an accommodating portion 13 of the fan 7 is disposed within the casing 1. The fan 7 and the baffles 12 are both disposed within the accommodating portion 13 of the fan 7, and the accommodating portion 13 of the fan 7 is provided with an air vent 14 facing the steam generator, such that the air can flow out from the air vent 14 to flow towards the steam generator, thus conducting a convective heat dissipation to the steam generator so as to allow a temperature of an outer wall of the steam generator to be lower than a safe temperature.

In some embodiments of the present disclosure, a partition plate assembly 6 extends downwards from the bottom wall 16 of the casing, the partition plate assembly 6 is configured to have a volute shape, and the vortex air duct is defined by the partition plate assembly 6, the bottom wall 16 of the casing and the base 2 together. Specifically, a bottom portion of the casing 1 is open, the partition plate assembly 6 is disposed on the bottom wall 16 of the casing and located beneath the fan 7, the base 2 is used to close the bottom portion of the casing 1, and the partition plate assembly 6 is disposed between the bottom wall 16 of the casing and the base 2. The partition plate assembly 6 may include a plurality of partition plates, the plurality of partition plates are spaced apart from one another, and the air flows among the plurality of partition plates, so that the noise produced by the flowing air can be blocked.

In some specific examples of the present disclosure, as shown in FIG. 3, the partition plate assembly 6 includes a first partition plate 61 and a second partition plate 62. The first partition plate 61 defines a first ring cavity and a flat-straight cavity 611 communicated with the first ring cavity, in which the flat-straight cavity 611 is communicated with the air inlet 4. The second partition plate 62 defines a second ring cavity and is disposed inside the first ring cavity, in which a first flow channel 612 having a gradually decreasing width is defined between the second partition plate 62 and the first partition plate 61. The second ring cavity is provided with an opening 15 thereinside, the opening 15 is communicated with an air intake end of the heat dissipation fan wheel 72, and the first flow channel 612 is communicated with the opening 15 via a second flow channel 622 located in the second ring cavity.

Specifically, as shown in FIG. 3, the first partition plate 61 defines the first ring cavity and the flat-straight cavity 611 thereinsde, in which the flat-straight cavity 611 is disposed adjacent to the air inlet 4 and communicated with the air inlet 4, and the first ring cavity is disposed downstream of the flat-straight cavity 611. The first partition plate 61 is disposed outside of the second partition plate 62 and spaced apart from the second partition plate 62, the first flow channel 612 is defined between the second partition plate 62 and the first partition plate 61, and the width of the first flow channel 612 gradually decreases along a flow direction of the air, i.e. a flow area of the air in the first flow channel 612 decreases gradually.

As shown in FIG. 3, the width of the first flow channel 612 gradually decreases along a counter-clockwise direction, and the air flows along a direction in which the first flow channel 612 is convergent and has a moving direction consistent with that of the air in the heat dissipation fan wheel 72. Further, as shown in FIG. 3, the first flow channel 612 may be configured to be a channel in the logarithmic spiral shape. In the example shown in FIG. 3, the first partition plate 61 has the logarithmic spiral shape, the second partition plate 62 has a circular shape, and a circle center of the second partition plate 62 is coincident with a center of a logarithmic spiral line of the first partition plate 61. Thus, the first flow channel 612 defined between the first partition plate 61 and the second partition plate 62 has the gradually decreasing width. Certainly, it may be understood that, in some other embodiments of the present disclosure, the first flow channel 612 and the flat-straight cavity 611 may constitute the structure having the logarithmic spiral shape together.

The opening 15 is formed in the bottom wall of the casing 1, runs through the bottom wall of the casing 1 and is communicated with the air intake end of the heat dissipation fan wheel 72. The second partition plate 62 surrounds the opening 15 and the second ring cavity is defined inside the second partition plate 62. The second flow channel 622 is defined within the second ring cavity, and the first flow channel 612 and the opening 15 are communicated via the second flow channel 622, such that the air flows from the first flow channel 612 to the second flow channel 622 and further to the air intake end of the heat dissipation fan wheel 72. Accordingly, it is convenient for the air to form a vortex by flowing through the first flow channel 612 and the second flow channel 622, thus promoting the flow of the air.

Optionally, the second partition plate 62 may be configured to be a ring plate and the ring plate has at least one first notch 621. A communication of the first flow channel 612 and the second ring cavity can be realized via the first notch 621. As shown in FIG. 3, a plurality of the first notches 621 may be provided, and the air in the first flow channel 612 flows to the second ring cavity via the first notches 621, thus facilitating the flow of the air.

Further, the at least one first notch 621 may be formed in a position along the ring plate away from the flat-straight cavity 611. As shown in FIG. 3, a plurality of the first notches 621 may be provided in a portion of the ring plate away from the flat-straight cavity 611. Thus, in the flat-straight cavity 611 and in a part of the first flow channel 612 from the flat-straight cavity 611 to the first notch 621, the air gathers and presents the convergent flow, such that the air is prevented from dispersing and flows to the second ring cavity through the first notch 621 directly.

Further, two to five first notches 621 may be provided and spaced apart from one another. As shown in FIG. 3, four first notches 621 are provided and spaced apart from one another along a circumferential direction of the ring plate, and the air in the first flow channel 612 flows to the second flow channel 622 via the four first notches 621.

In some specific examples of the present disclosure, the partition plate assembly 6 may further include a third partition plate 63 disposed around the opening 15 and having at least one second notch 631, in which the first notch 621 is communicated with the second notch 631 via the second flow channel 622. Thus, the first flow channel 612 and the second flow channel 622 are communicated via the first notch 621, and the second flow channel 622 is communicated with the opening 15 at an inlet end of the heat dissipation air duct in the bottom wall of the casing 1, such that the air flows form the first flow channel 612 to the second flow channel 622 via the first notch 621, and further flows to the opening 15 via the second notch 631 after a circulation in the second flow channel 622. Meanwhile, the noise produced by the flowing air can be blocked by the third partition plate 63, and the noise is reflected between the third partition plate 63 and the second partition plate 62, thus further reducing the noise of the fan 7.

Optionally, the second notch 631 is arranged away from the first notch 621. Thereby, the air flows from the first flow channel 612 to the second flow channel 622 via the notches, and since the second notch 631 is away from the first notch 621, the air flows from the second notch 631 to the air intake end of the fan 7 after flowing a certain distance in the second flow channel 622, so that it is convenient for the air to form the vortex, thus promoting the flowing of the air. Further, the third partition plate 63 is concentric with the second partition plate 62. In the example shown in FIG. 3, the second notch 631 and the first notch 621 are disposed radially symmetrically, such that the air can flow a longest flow distance form the first notch 621 to the second notch 631, thus further promoting the flowing of the air.

In some embodiments of the present disclosure, a hollow cavity 5 is further defined between the bottom wall 16 of the casing and the base 2, the air inlet 4 is corresponding to the hollow cavity 5 in terms of positions thereof, and the vortex air duct is communicated with the hollow cavity 5. Therefore, the air flows from the air inlet 4 to the hollow cavity 5, and further from the hollow cavity 5 to the vortex air duct, such that a resonance cavity structure can be formed via the hollow cavity 5, thus providing a certain effect of resonance-style noise reduction. Further, noise reduction materials may be provided at the air inlet 4, so that the noise can be lowed further.

Optionally, a control mainboard 3 of the steam cleaner 100 is disposed within the hollow cavity 5, so that the air entering from the air inlet 4 passes through the control mainboard 3 firstly. As shown in FIG. 1 and FIG. 3, the control mainboard 3 is disposed within the hollow cavity 5 and corresponding to the air inlet 4 in terms of positions thereof, and the control mainboard 3 radiates heat within the hollow cavity 5. Furthermore, the air flows from the air inlet 4 to the hollow cavity 5, and further to the vortex air duct, so as to take away the heat in the hollow cavity 5 to realize the heat dissipation of the control mainboard 3, and therefore it is needless to add a heat dissipation fan or design a heat dissipation channel separately, thus saving a cost.

Further, at least one of a length, a width and a depth of the hollow cavity 5 may be larger than a corresponding dimension of the control mainboard 3. For example, the length of the hollow cavity 5 is larger than a length of the control mainboard 3, while the width and the depth of the hollow cavity 5 are identical with a thickness and a width of the control mainboard 3, respectively. Thus, it is convenient to arrange the control mainboard 3, and also convenient for the air to flow in the hollow cavity 5. Moreover, a contact area of the air and the control mainboard 3 is increased, such that it is convenient for the air to exchange heat with the control mainboard 3 in the hollow cavity 5, thus improving the heat dissipation effect of the control mainboard 3.

Other configurations and operations of the steam cleaner 100 according to embodiments of the present disclosure are known to those skilled in the related art, and will not be described in detail herein.

Reference throughout this specification to "an embodiment", "some embodiments", "an illustrative embodiment", "an example", "a specific example" or "some examples" means that a particular feature, structure, material, or characteristic described in connection with the embodiment or example is included in at least one embodiment or example of the present disclosure. Thus, the appearances of the phrases above in various places throughout this specification are not necessarily referring to the same embodiment or example of the present disclosure. Furthermore, the particular features, structures, materials, or characteristics may be combined in any suitable manner in one or more embodiments or examples.

Although embodiments of the present disclosure have been shown and described, it would be appreciated by those skilled in the art that changes, variations, alternatives, and modifications can be made in the embodiments without departing from spirit and principles of the present disclosure, the scope of the present disclosure is limited by the claims and their equivalents.

What is claimed is:

1. A steam cleaner, comprising:

a base provided with an air inlet;

a casing disposed on the base and having an air outlet in a side wall thereof, wherein a vortex air duct is defined between a bottom wall of the casing and the base, and the air inlet is in fluid communication with the vortex air duct; and a fan disposed within the casing, the fan comprising an electric motor and a heat dissipation fan wheel connected to a lower end of an electric motor shaft of the electric motor, wherein the vortex air duct is configured to guide air entering from the air inlet to the heat dissipation fan wheel to dissipate heat of the electric motor, wherein a partition plate assembly extends downwards from the bottom wall of the casing, the partition plate assembly being configured to have a volute shape, and the vortex air duct is defined by the partition plate assembly, the bottom wall of the casing and the base together, wherein the partition plate assembly comprises:

a first partition plate defining a first ring cavity and a flat-straight cavity communicated with the first ring cavity, wherein the flat-straight cavity is communicated with the air inlet;

a second partition plate defining a second ring cavity and disposed inside the first ring cavity, wherein a first flow channel having a gradually decreasing width is defined between the second partition plate and the first partition plate, the second ring cavity being provided with an opening there-inside, wherein the opening is communicated with an air intake end of the heat dissipation fan wheel, and the first flow channel is communicated with the opening via a second flow channel located in the second ring cavity.

2. The steam cleaner according to claim 1, wherein the second partition plate is configured to be a ring plate and the ring plate has at least one first notch.

3. The steam cleaner according to claim 2, wherein the at least one first notch is formed in a position along the ring plate away from the flat-straight cavity.

4. The steam cleaner according to claim 3, wherein two to five first notches are provided and spaced apart from one another.

5. The steam cleaner according to claim 2, further comprising:

a third partition plate disposed around the opening and having at least one second notch, wherein the at least one first notch is communicated with the at least one second notch via the second flow channel.

6. The steam cleaner according to claim 5, wherein the at least one second notch is arranged away from the at least one first notch in a circumferential direction of the opening.

7. The steam cleaner according to claim 6, wherein the third partition plate is concentric with the second partition plate.

8. The steam cleaner according to claim 1, wherein a hollow cavity is further defined between the bottom wall of the casing and the base, the air inlet is corresponding to the hollow cavity in terms of positions thereof, and the vortex air duct is communicated with the hollow cavity.

9. The steam cleaner according to claim 8, wherein a control mainboard of the steam cleaner is disposed within the hollow cavity, so that the air entering from the air inlet passes through the control mainboard firstly.

10. The steam cleaner according to claim 9, wherein at least one of a length, a width and a depth of the hollow cavity is larger than a corresponding dimension of the control mainboard.

* * * * *